US005088732A

United States Patent [19]

Kim

[11] Patent Number: 5,088,732

[45] Date of Patent: Feb. 18, 1992

[54] COME BACK SOLO TENNIS

[76] Inventor: Ji K. Kim, 690 Wilshire Pl., Los Angeles, Calif. 90005

[21] Appl. No.: 653,502

[22] Filed: Feb. 11, 1991

[51] Int. Cl.[5] ..... A63B 61/00

[52] U.S. Cl. ..... 273/29 A; 273/58 C; 273/26 E; 273/443

[58] Field of Search ..... 273/26 E, 29 A, 58 C, 273/29 R, 29 A, 200 R, 413

[56] References Cited

U.S. PATENT DOCUMENTS

| | | | |
|---|---|---|---|
| 3,297,321 | 1/1967 | Kuhnes et al. | 273/26 E |
| 3,494,621 | 2/1970 | Windall | 273/200 R |
| 3,502,337 | 3/1970 | Butkus | 273/200 R |
| 3,521,887 | 7/1970 | Butkus | 273/200 R |
| 3,767,198 | 10/1973 | Boyer | 273/26 E |
| 3,804,409 | 4/1974 | Schachner | 273/58 C |
| 3,918,712 | 11/1975 | Fey | 273/58 C |
| 4,095,787 | 6/1978 | Saferstein | 273/26 E |
| 4,095,798 | 6/1978 | Marple | 273/58 C |
| 4,147,353 | 4/1979 | Moore | 273/58 C |
| 4,174,107 | 11/1979 | Hickey | 273/58 C |
| 4,350,338 | 9/1982 | May | 273/58 C |
| 4,660,835 | 4/1987 | Locurto | 273/58 C |
| 4,989,877 | 2/1991 | Bias | 273/200 R |

FOREIGN PATENT DOCUMENTS

| | | | |
|---|---|---|---|
| 25611 | 12/1935 | Australia | 273/200 R |
| 544180 | 12/1932 | Fed. Rep. of Germany | 273/200 R |
| 322044 | 11/1929 | United Kingdom | 273/200 R |

*Primary Examiner*—Theatrice Brown
*Attorney, Agent, or Firm*—Erik M. Arnhem

[57] ABSTRACT

A game in which a single player strikes a tennis ball with a conventional tennis racket so that the ball is driven away from the point in which the player is standing. The tennis ball is attached to a flexible cable that includes a non-extensible section and an elastic resilient section; one end of the cable is connected to an anchorage device stationed adjacent the player. The cable is designed to pull the driven tennis ball back toward the anchorage device. If the ball is properly struck the ball will bounce one time and be in a strike zone a few inches above the flat playing surface before it returns to the anchorage device. The anchor device is a flexible bag having a zippered opening for placement of a weighty granular material into the bag.

1 Claim, 1 Drawing Sheet

COME BACK SOLO TENNIS

BACKGROUND AND SUMMARY OF THE INVENTION

This invention relates to a game wherein a tennis ball is connected to a fixed anchorage device via an elongated flexible cable. The anchorage device is placed on a pavement surface, after which the player strikes the ball with a conventional tennis racket to drive the ball away from a point above the anchorage device. Elasticity built into the cable enables the cable to exert a return force on the ball. The ball is pulled back toward the anchorage device. However, gravitational forces cause the ball to drop onto the pavement surface before the ball is able to reach the anchorage device. The ball bounces off the pavement surface so that when it reaches the vicinity of the anchorage device it is several inches above the pavement surface. The player can thus swing the tennis racket to again drive the tennis ball away from the anchorage device. The process is repeated as long as the player is able to control the flight of the ball.

The game can be used for competition purposes by having two or more players take turns at striking the tennis ball; the player accomplishing the greatest number of ball strike cycles can be considered the winner. The game can also function as a training device for enabling a player to learn successful techniques of striking a tennis ball useful in an actual game of tennis on a tennis court. The stroke used in the present game is similar to the ground strokes needed in an actual tennis game.

In some respects the game of this invention is similar to a game already known, wherein a small rubber ball is connected to a flat wooden paddle via a rubber band. That game is played by moving the paddle back and forth so that the ball alternately rebounds away from the paddle surface and returns back to the paddle surface due to the elastic force of the rubber band. However, in that game the ball never strikes the ground or pavement surface; instead the ball moves directly toward or directly away from the paddle surface. The present invention uses a ground mounted anchorage device that is not employed in the above-referenced paddle game.

THE DRAWINGS

DESCRIPTION OF A PREFERRED EMBODIMENT OF THE INVENTION

Figure 1:
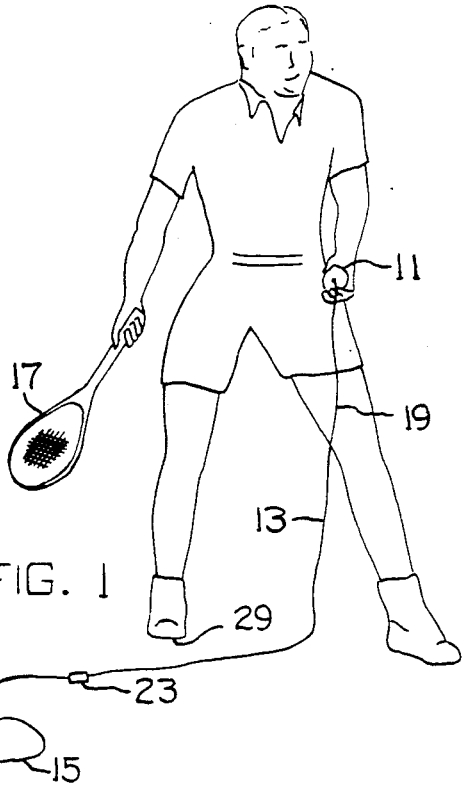
FIG. 1 illustrates a person in position to play a game embodying features of the invention.
Figure 3:
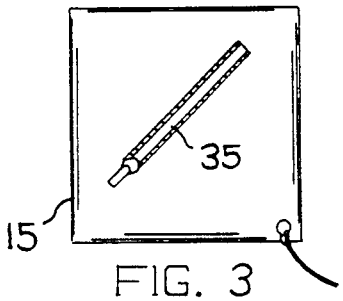
FIG. 3 illustrates features of a weighted anchorage device forming part of the FIG. 1 game apparatus.

FIG. 1 shows a game apparatus comprising a conventional tennis ball 11 attached to an elongated flexible cable 13. The other end of cable 13 is attached to a weighted bag 15 that forms an anchorage device for the cable and tennis ball. The anchorage device is preferably constituted as bag filled with sand or pebbles having ideally a weight of about three pounds, so as to secure the immobility of the anchorage device during the game.

As shown in FIG. 1, the person holds tennis ball 11 in one hand and a conventional tennis racket 17 in his other hand, standing preferably on a flat surface, e.g. a driveway or basement floor or outdoor patio. The person will lean forward and hold the tennis ball at approximately waist level; at the same time he will swing the tennis racket in an essentially horizontal arc against the ball, thereby driving the ball in accordance with the direction of the swing. As seen in FIG. 1, the tennis ball will be driven in a left-to-right direction.

Figure 2:
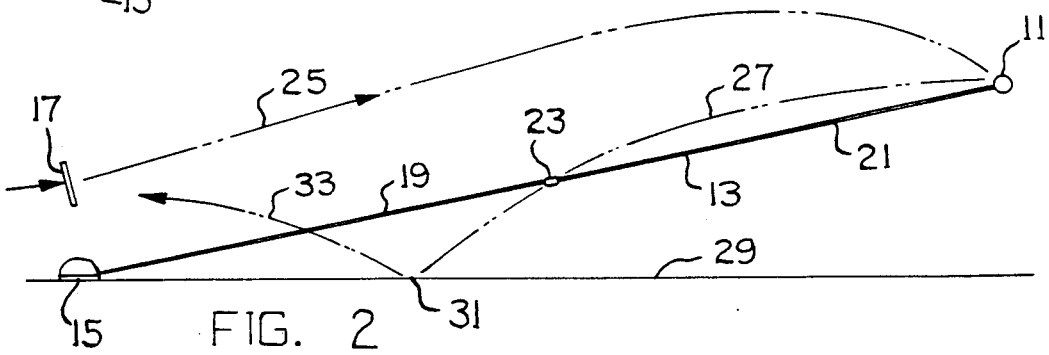
FIG. 2 is a diagrammatic illustration of the flight of a tennis ball used in the FIG. 1 game apparatus.

As the ball leaves the face of the tennis racket it will exert a pulling force on the attached cable 13, thereby causing the cable to be reconfigured into a taut straight line condition, as shown in FIG. 2. Cable 13 includes a flexible non-extensible line 19, and a flexible elastic cord 21. Non-extensible line 19 is preferably a fairly strong but light weight length of flexible twine or thick string formed for example out of woven nylon thread material. Elastic cord 21 is preferably a relatively heavy rubber band having a transverse diameter of approximately one eighth inch; the cord can have a square cross section or a circular cross section. Line 19 and elastic cord 21 are joined together by a swivel connector 23.

FIG. 2 illustrates generally the flight of tennis ball 11 after it is struck by tennis racket 17. Initially the ball travels away from the racket along trajectory 25. It pulls cable 13 into a straight line condition. When the cable becomes taut the elastic section 21 of the cable begins to stretch, thereby slowing the ball velocity along trajectory 25. The tension force established in elastic section 21 pulls the ball back toward racket 17 along path 27; FIG. 2 shows the ball as it is beginning its return flight along path 27. At this same time gravitational force acts to move the ball in a downward arc so that it impacts the pavement surface 29, as at 31. The ball rebounds from the pavement along path line 33.

The lengths of cable sections 19 and 21 are selected so that when the tennis ball reaches the ball-hitting zone above anchorage device 15 it is about at knee level or waist level; at that point the ball will be essentially directly above anchorage device 15, due to the line of action of the elastic section 21 of the cable. The player can strike the ball with racket 17 again, thereby starting the ball along trajectory 25. Non-extensible section 19 of the cable is preferably about eight feet long; elastic section 21 is preferably about six feet long in its normal unstressed condition. The total unstressed length of the cable is thus about fourteen feet.

The cable length can be varied to a certain extent from the above-described fourteen foot length dimension. However, it is believed that the unstressed cable length should be at least about twelve feet and no more than about sixteen feet. If the cable is too short the bounce point 31 will be too close to anchorage device 15 when the person takes a normal swing with racket 17. If the cable is too long the bounce point 31 will be so far away from anchorage device 15 that the ball may bounce a second time near the anchorage device, such that the person will not be in a favorable position to hit the ball cleanly with the racket. The action is affected somewhat by the amount of elasticity built into elastic cord 21.

As shown in FIG. 1, anchorage device 15 e.g. the sand filled bag is situated behind the tennis player. The bay may be held against pavement surface 29 by the pressure of the person's foot; however by itself the filled bag has enough mass to remain in a fixed and stationary position. Since sufficient mass is in the form of e.g. sand, weighing about 3 pounds added to bag device 15, it will resist being displaced by the rightward inertia of ball 11. Alternatively, a heavy metal plate can be placed in the bag. Also, the lower face of the bag bottom wall can be coated with rubber coating to deter slippage of the bag along flat surface 29.

Bag 15 is originally a flat cloth envelope structure having a flat bottom wall and a flat top wall; the two walls are joined together along their edges to form a bag interior space. The top wall of the bag has a zippered opening 35 therein for placement of a stabilizer material into the bag.

Figure 4:
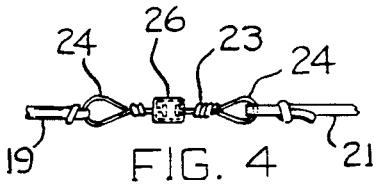
FIG. 4 illustrates a swivel connector used in a flexible cable that forms part of the FIG. 1 game apparatus.

As previously indicated, non-extensible line 19 and elastic cord 21 are joined together by means of a swivel connector 23. FIG. 4 shows some features of a swivel connector that can be used. The connector comprises two wire loops 24 attached, respectively, to line 19 and elastic cord 21 by knots. Each wire loop has an axial wire portion extending into a small metal barrel (tube) 26. Ends of the wire portions within tube 26 are turned at an angle so that the wire loops cannot be pulled out of the tube; the tube ends are flanged inwardly to trap the wire end portions. However, either wire loop can turn freely around the barrel (tube) axis. The swivel action of connector 23 is somewhat helpful in tending to prevent undesired twisting of line 19 or cord 21.

A principal feature of the invention is the composite nature of cable 13, wherein the cable includes a non-extensible section 19 and an extensible (elastic) section 21. The cable has a fairly long length (about fourteen feet), while having only a limited elastic resilience. The resilience offered by the six foot section 21 is enough to return ball 11 back along paths 27 and 33 without producing an unduly large velocity component when the ball moves towards the zone above anchorage device 15; the player has sufficient opportunity to strike the ball before it has passed leftwardly beyond the striking zone above anchorage device 15.

The drawings necessarily show a specific form of the invention form of the invention. However, it will be appreciated that some variation in structure and choice of materials may be exercised while still practicing the invention.

What is claimed is:

1. A game apparatus comprising a tennis ball; an anchorage devices locatable at a fixed point on a pavement surface; said anchorage device defining a ball-hitting zone directly thereabove; an elongated flexible cable means having one off its ends attached to said anchor device and its other end attached to the tennis ball; and a tennis racket; said elongated cable means comprising a flexible non-extensible line and an interconnected flexible elastic cord section; said cable means having a length of several feet, whereby a person standing adjacent the anchorage device can swing the tennis racket through said ball-hitting zone to drive the tennis ball away from the anchorage device above the pavement surface, such that the flexible elastic cord section is stretched to exert a force for returning the tennis ball towards the anchorage device; the length of the cable means being such that gravitational forces cause the tennis ball to bounce at least once on the pavement surface before reaching the ball-hitting zone; said anchorage device comprising a flat bag having a flat flexible bottom wall and a flat flexible top wall joined together along their edges, and a weighty granular material filling the space between said walls; said top wall having a zippered opening therein for placement of said weighty granular material into the bag.

* * * * *